US006153868A

United States Patent [19]

Marzat

[11] Patent Number: 6,153,868

[45] Date of Patent: Nov. 28, 2000

[54] MICROWAVE APPLICATION DEVICE, PARTICULARLY FOR BAKING PRODUCTS ON A METAL CARRIER

[75] Inventor: Claude Marzat, Talence, France

[73] Assignee: Groupe Danone, Paris, France

[21] Appl. No.: 09/101,887

[22] PCT Filed: Jan. 19, 1996

[86] PCT No.: PCT/FR96/00093

§ 371 Date: Aug. 6, 1998

§ 102(e) Date: Aug. 6, 1998

[87] PCT Pub. No.: WO97/26777

PCT Pub. Date: Jul. 24, 1997

[51] Int. Cl.[7] ..... H05B 6/78; H05B 6/74

[52] U.S. Cl. ..... 219/695; 219/699; 219/701; 219/746; 219/750; 219/762

[58] Field of Search ..... 219/699, 700, 219/701, 680, 681, 684, 756, 762, 746, 695, 697, 750

[56] References Cited

U.S. PATENT DOCUMENTS

| | | | |
|---|---|---|---|
| 2,500,752 | 3/1950 | Hanson et al. | 219/700 |
| 2,603,741 | 7/1952 | Seifried et al. | 219/701 |
| 3,177,333 | 4/1965 | Lamb | 219/699 |
| 3,665,491 | 5/1972 | Cooper | 219/701 |
| 4,999,469 | 3/1991 | Dudley et al. | 219/693 |
| 5,177,333 | 1/1993 | Ogasawara | 219/680 |
| 5,796,080 | 8/1998 | Jennings et al. | 219/750 |

FOREIGN PATENT DOCUMENTS

| | | |
|---|---|---|
| 0 581 973 | 2/1994 | European Pat. Off. . |
| 2 067 059 | 7/1981 | United Kingdom . |

*Primary Examiner*—Philip H. Leung
*Attorney, Agent, or Firm*—Young & Thompson

[57] ABSTRACT

A device for applying microwaves particularly for cooking products on a metallic support, includes at least one microwave generator (G) and a metallic waveguide, particularly of rectangular cross section (1, 11, 11', 11", 11"'). The waveguide forms a cooking chamber whose floor is constituted by a removable flat metallic support (5, T), on which are disposed the products to be cooked (6).

11 Claims, 1 Drawing Sheet

MICROWAVE APPLICATION DEVICE, PARTICULARLY FOR BAKING PRODUCTS ON A METAL CARRIER

BACKGROUND OF THE INVENTION

The present invention relates to a device for applying microwaves for the treatment, in particular the cooking, of relatively small or thin individual products, disposed on a metallic support. There is meant by microwaves the frequency band of electromagnetic waves comprised between 300 MHz and 300 GHz.

SUMMARY OF THE INVENTION

The object of the invention is to provide a structure adapted particularly for cooking food products, for example biscuits, in place on a metallic surface and capable of operating, during very substantially reduced times relative to the cooking time in conventional ovens with pulsed hot air cooking and/or infrared cooking, with comparable cooking quality and under very good conditions of safety in spite of the use as a cooking support for said products a metal surface, for example a fixed grill or bottom or a conveyor belt.

To this end, the invention has for its object a device for applying microwaves particularly for cooking products on a metallic support, comprising at least one microwave generator and a metallic waveguide, particularly of rectangular cross section, characterized in that said waveguide forms a cooking chamber whose floor is constituted by a removable flat metallic support on which are disposed the products to be cooked.

Preferably, the waveguide is connected to the microwave generator by an auxiliary guide whose axis forms relative to the axis of said guide, an angle equal to the Brewster angle or near it, and such that the electric field will be in a plane perpendicular to the flat metallic support.

According to one embodiment, said flat metallic support is a base or plate stationary relative to the upper inverted U-shaped portion of the microwave guide during application of the microwaves, the two ends of the guide being provided with closure-confinement means for the cooking chamber thus formed.

According to another embodiment, said flat metallic support is a conveyor belt, the two ends of the guide being if desired provided with means suitable to limit the escape of waves to the exterior to below tolerated values, the direction of movement of the belt being parallel to the axis of the guide.

Preferably, according to a second embodiment, the device of the invention comprises a plurality of waveguides twinned in parallel forming a mono-mode microwave cavity, the lower horizontal portion of the guides being formed by a common conveyor belt.

As a modification, such a conveyor belt, whether the waveguide is mono or multi-conduit, serves several waveguide cavities arranged in cascade above the upper run of the belt, such that the products are subjected in the course of their movement along the conveyor belt, to a succession of microwave applications.

BRIEF DESCRIPTION OF THE DRAWINGS

Other characteristics and advantages will become apparent from the description which follows, of embodiments of the invention, which description is given by way only of example and with regard to the accompanying drawings, in which.

DETAILED DESCRIPTION OF THE INVENTION

Figure 1:
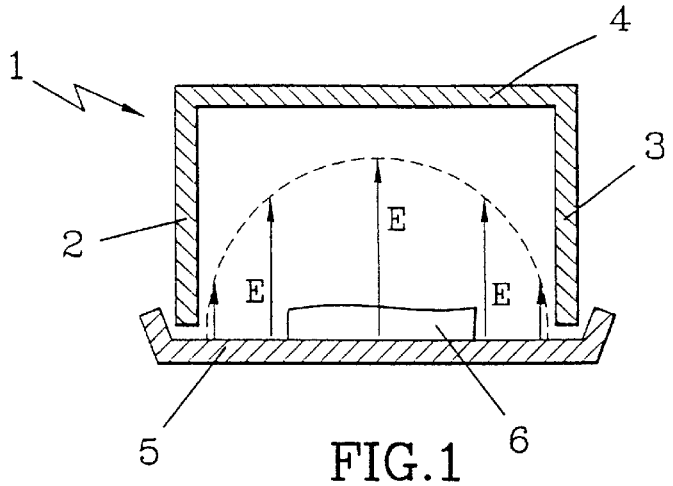
FIG. 1 is a schematic vertical cross-sectional view of a first embodiment of a device according to the invention.

In FIG. 1, there is shown at 1 a microwave of rectangular cross section comprising two side walls 2 and 3 and an upper wall 4, the lower wall being constituted by a separate flat support 5.

The guide 1 and the flat support 5 are of a metal which is a good conductor and preferably non-magnetic.

Guide 1 forms a closed chamber (the opposite ends not being shown in FIG. 1) which is open only on its lower surface, the opening being closed by the flat support 5 which is for example a base or plate on which are disposed products 6, for example biscuits, madeleines, or other bakery or viennese or pastry products of the same type, that it is desired to cook or of which it is desired to control the moisture content.

The guide 1 is connected to a microwave generator (not shown in FIG. 1) connected such that the electric field E created in the guide 1 will be substantially perpendicular to the flat metallic support 5 during its longitudinal propagation.

The assembly thus constituted can comprise an individual cooking oven whose sole or cooking plate 5 can be removed to load and unload the products, the device operating as a conventional microwave oven.

Figure 2:
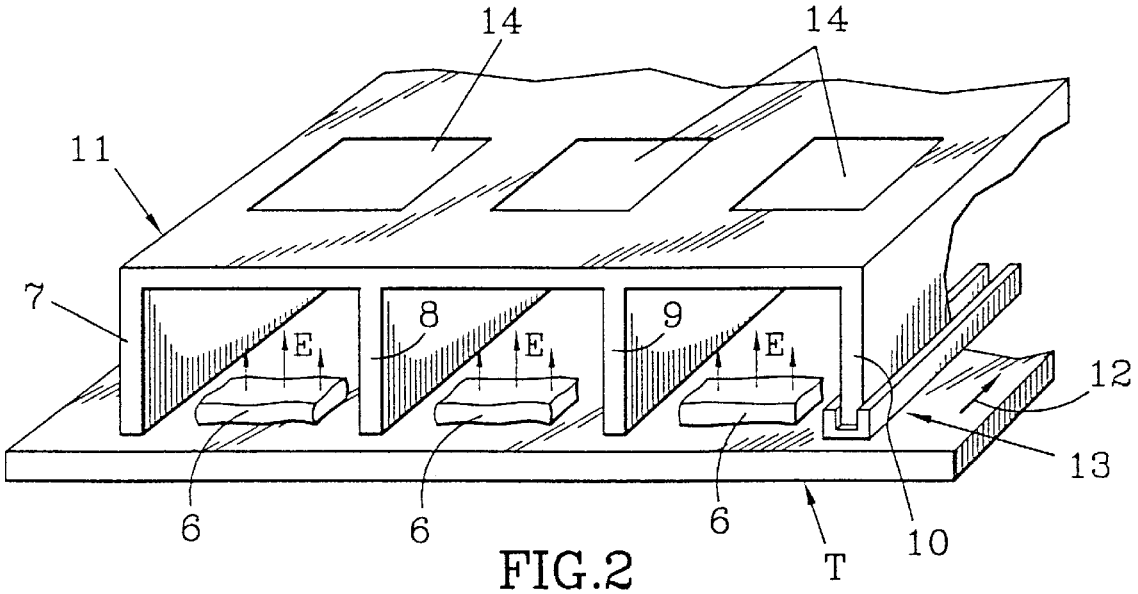
FIG. 2 is a schematic vertical cross-sectional view of a second embodiment.

FIG. 2 shows another embodiment in which, on the one hand, several waveguides similar to the guide 1 are twinned or coupled so as to form three rectangular conduits open on their lower side and, on the other hand, the flat metallic support 5 is constituted by a single common element, and more particularly by the upper run of a conveyor belt T. The upper run of the belt T circulates whilst being maintained at a small distance (1 to 10 mm at a frequency of 2450 MHz) from the edge of the vertical separating columns 8 and 9 of the side-by-side waveguides forming a mono-mode microwave cavity 11.

The belt is driven in the direction 12 parallel to the axis of the conduits of the cavity 11.

Preferably, between the edge of the sides 7 and 10 of the cavity 11 and the belt T are interposed U-shaped profiles forming wave traps indicated at 13 and adapted to reduce as much as possible the loss of microwaves.

Preferably, the waves are sent into each of the conduits of the cavity 11 substantially with Brewster incidence, by means of openings 14 provided in the upper horizontal wall of the cavity 11.

On these openings 14 are fixed auxiliary guides of rectangular cross section whose axes are inclined to the axis of the conduits of cavity 11 by an angle of the order of the Brewster angle for the type of products 6 to be treated, which is to say at about 30° with the horizontal, the electric field emitted remaining in a plane perpendicular to the metallic belt.

The width of the conduits of cavity 11 is for example of the order of 8 to 10 cm for a microwave generator whose frequency is 2450 MHz±50 MHz operating in a fundamental $TE_{10}$ mode, the height of the conduits being of the order of 4 to 5 cm, at a distance from the belt comprised between about 1 and 10 mm and the length of the order of 60 to 120 cm. In the case of the frequency 915 MHz and more generally, other frequencies for ISM use (Industrial, Scientific and Medical), these dimensions will be different, substantially inversely proportional to the frequencies.

The cavity 11 can of course comprise any variable number of different conduits, this number being adapted to be as small as 1.

Figure 3:
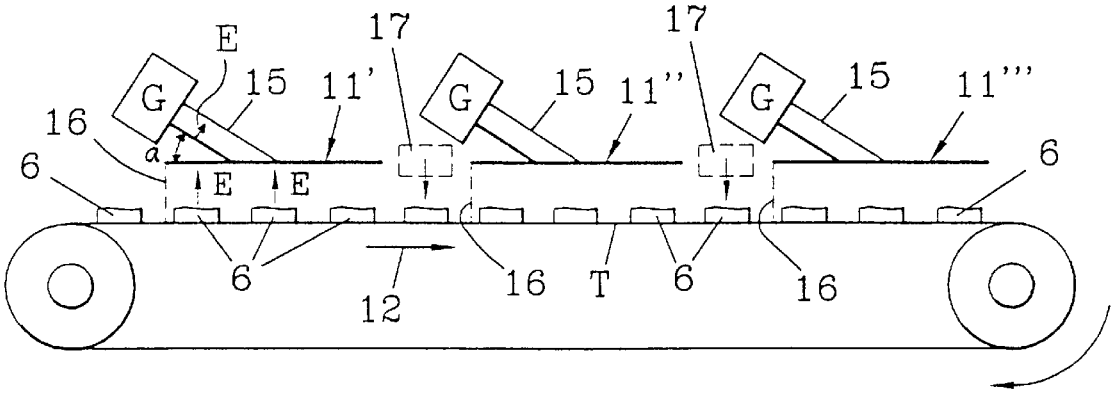
FIG. 3 is a schematic side view of a modified embodiment of the device of FIG. 2.

In FIG. 3, there is shown in side elevation a conveyor belt T driving the products 6 to be cooked successively into three aligned cavities 11', 11", 11"', for example identical to the cavity 11 of FIG. 2.

Each cavity 11', 11", 11"', which can be mono or multi-conduits, comprises as many microwave generators G as conduits, disposed above the conduits and each connected to a conduit by an auxiliary guide 15 inclined at an angle a equal to the Brewster angle or near this latter for products to be treated with an electric field direction emitted in a plane perpendicular to the metallic belt.

The auxiliary guides 15 open onto the respective conduits through corresponding openings 14 which are disposed nearer the upstream end of the conduits than the downstream end. The axis of the auxiliary conduits 15 intersects the axis of the conduits of the cavities 11', 11", 11"' and defines with them vertical planes parallel to the direction of movement 12 of the belt T.

The length of the conduits of the cavities is such that at the downstream end, it is not necessary to provide a sophisticated anti-escape device, the microwave energy having been practically entirely absorbed. The distance between said end and the juncture point between the cavity and the auxiliary guide 15 being greatly superior to one or several wavelengths.

By contrast, at the upstream end, there can advantageously be provided an anti-escape device, such as a wave trap, curtain of suspended chains symbolized at 16, material absorbent of microwaves, etc . . . .

Between two cavities can be interposed a complementary heating/cooking device shown at 17, dispensing for example heating by pulsed air or by infrared radiation.

In the embodiment of FIG. 3, the products 6 are subjected to three successive applications of microwaves, interspersed with a rest phase or an auxiliary heating/cooking phase.

The dwell time of the products in the conduits of the cavities of course depends on their nature and on the type of cooking desired.

The number of successive cavities can of course vary and be greater than 3.

Generally speaking, the invention is applicable to all types of cavity or waveguide, of rectangular section, square, semi-circular or other, to the extent the lower wall of the cavity or of the waveguide can be replaced by a flat thin separable metallic support, movable or not relative to the body of the cavity or of the waveguide and on which are disposed, directly or not, the products to be cooked, the latter being constituted by individual elements of relatively reduced size.

The guides and cavities operate generally in $TE_{n01}$ mode, in one of said frequencies for ISM applications.

It is to be noted that the temperatures used in the course of cooking these types of products, namely of the order of 250° C., are easily borne by the metallic supports (5, T).

It is finally to be observed that the invention can be applied to other than the cooking of such products, for example, drying or regulation of moisture profiles, as well as to thermal treatment, generally speaking.

What is claimed is:

1. Device for applying microwaves to cooking food products, which comprises:

at least one microwave generator;

at least one waveguide having a longitudinal axis and being operatively connected to the microwave generator, said waveguide forming a cooking chamber; and a removable flat metallic support constituting a floor of said cooking chamber, said floor structured and arranged to support and contact said food products to be cooked; said waveguide further having a cross-section adapted to a monomode propagation such that an electrical field created in the waveguide is substantially perpendicular to said floor.

2. Device according to claim 1, wherein said monomode propagation is $TE_{10}$ mode.

3. Device according to claim 1, wherein said at least one waveguide is connected to said at least one microwave generator through an auxiliary waveguide having an axis which forms relative to the axis of said at least one waveguide, an angle equal or close to the Brewster angle.

4. Device according to claim 1, wherein said waveguide constitutes an individual cooking oven, said removable floor constituting a sole of said oven.

5. Device according to claim 1, wherein said removable floor is a conveyor belt having a direction of displacement which is parallel to the axis of said waveguide.

6. Device according to claim 5, further comprising a plurality of waveguides in parallel, each forming a monomode cavity, and a plurality of microwave generators, each connected to one of said waveguides, said conveyor belt constituting the floor of said waveguides.

7. Device according to claim 6, wherein said conveyor belt drives the products to be cooked successively into several monomode cavities, each of said cavities having at least a conduit, so that said products are subjected to a succession of microwave applications when said conveyor belt is moved through each of said cavities.

8. Device according to claim 7, further comprising an auxiliary heating/cooking device between two successive cavities.

9. Device according to claim 6, wherein said conduits of cavities are rectangular, and have a width comprised between 8 and 10 cm, a height comprised between 4 and 5 cm, and a length comprised between 60 and 120 cm for a microwave generator of a frequency 2,450 MHz operating in $TE_{10}$ mode.

10. Device according to claim 5, wherein said conveyor belt is induction heated.

11. Device according to claim 5, further comprising U-shaped profiles forming wave traps provided onto said conveyor belt in regard to edges of sides of said waveguide.

* * * * *